US005332051A

United States Patent [19]

Knowlton

[11] Patent Number: 5,332,051

[45] Date of Patent: Jul. 26, 1994

[54] OPTIMIZED PDC CUTTING SHAPE

[75] Inventor: R. Helene Knowlton, Houston, Tex.

[73] Assignee: Smith International, Inc., Houston, Tex.

[21] Appl. No.: 23,513

[22] Filed: Mar. 31, 1993

Related U.S. Application Data

[63] Continuation of Ser. No. 774,775, Oct. 9, 1991, abandoned.

[51] Int. Cl.[5] ..... E21B 10/46

[52] U.S. Cl. ..... 175/430; 175/431

[58] Field of Search ..... 175/430, 431, 432, 434, 175/428, 426

[56] References Cited

U.S. PATENT DOCUMENTS

| | | | |
|---|---|---|---|
| 4,109,737 | 8/1978 | Bovenkerk | 175/430 |
| 4,525,178 | 6/1985 | Hall | 51/309 |
| 4,570,726 | 2/1986 | Hall | 175/426 |
| 4,604,106 | 8/1986 | Hall et al. | 51/293 |
| 4,858,707 | 8/1989 | Jones et al. | 175/329 |
| 4,872,520 | 10/1989 | Nelson | 175/430 |
| 4,926,950 | 5/1990 | Zijsling | 175/430 |
| 4,984,642 | 1/1991 | Renard et al. | 175/430 |
| 4,997,049 | 3/1991 | Tank et al. | 175/430 |

*Primary Examiner*—Hoang C. Dang
*Attorney, Agent, or Firm*—Robert G. Upton

[57] ABSTRACT

The present invention relates to diamond drag bits having cylindrical polycrystalline diamond faced inserts with a convex cutting surface, the insert being imbedded in the cutting face of a drag bit. The invention teaches an optimization of the geometry of the cutting face of cutting elements, particularly of the type in which a diamond layer is adhered to a cemented carbide substrate to form a composite, and the composite is bonded to a support stud or cylinder. The convex curvature radius is maximized to the extent that the best shear action on the earthen formation is achieved. The resultant side rake angle assures that each insert remains free of detritus presenting a clean cutting edge to the formation.

3 Claims, 6 Drawing Sheets

OPTIMIZED PDC CUTTING SHAPE

CROSS-REFERENCE TO RELATED APPLICATION

This application is a continuation of application Ser. No. 774,775, filed Oct. 9, 1991, entitled OPTIMIZED PDC CUTTING SHAPE, now abandoned.

BACKGROUND OF THE INVENTION

I. Field of the Invention

The present invention relates to diamond drag bits having cylindrical polycrystalline diamond faced inserts imbedded in the cutting face of a drag bit.

More particularly, the present invention relates to the optimization of the geometry of the cutting face of cutting elements, particularly of the type in which a diamond layer or other superhard material is adhered to a cemented carbide substrate to form a composite, and the composite is bonded to a support stud or cylinder. Alternately the support cylinder can be an integral part of the diamond substrate backing.

II. Description of the Prior Art

One type of cutting element used in rotary drilling operations in subterranean earth formations comprises an abrasive composite or compact mounted on a support cylinder or stud. The composite typically comprises a diamond layer adhered to a cemented carbide substrate, e.g., cemented tungsten carbide, containing a metal binder such as cobalt, and the substrate is brazed to the support cylinder or stud. Alternately, the support cemented tungsten carbide cylinder may be integrally formed as part of the polycrystalline diamond substrate backing. Mounting of these cutting elements in a drilling bit is achieved by press fitting, brazing or otherwise securing the stud or cylinder backing into pre-drilled holes in the drill bit head.

Fabrication of the composite is typically achieved by placing a cemented carbide cylinder into the container of a press. A mixture of diamond grains and a catalyst binder is placed atop the substrate and is compressed under ultra-high pressure and temperature conditions. In so doing, the metal binder migrates from the substrate and "sweeps" through the diamond grains to promote a sintering of the diamond grains. As a result, the diamond grains become bonded to each other to form a diamond layer and also bonded to the substrate along a planar interface. Metal binder (e.g. cobalt) remains disposed within the pores defined between the diamond grains.

A composite formed in this manner may be subject to a number of shortcomings. For example, the coefficient of thermal expansion of the cemented tungsten carbide and diamond are somewhat close, but not exactly the same. Thus during the heating or cooling of the composite in the manufacturing process or during the work cycles the cutter undergoes in the drilling process creates significantly high cyclic tensile stresses at the boundary of the diamond layer and the tungsten carbide substrate. The magnitude of these stresses is a function of the disparity of the thermal expansion coefficients. These stresses are quite often of such magnitude to cause delamination of the diamond layer.

This limitation has been greatly minimized by adding a transition layer of mixed diamond particles and presintered tungsten carbide between the full diamond layer and the carbide substrate, as taught by U.S. Pat. Nos. 4,525,178 and 4,604,106 assigned to the same assignee as the present invention and incorporated herein by reference.

Another shortcoming of state of the art diamond composite compact technology described above is the difficulty of producing a composite compact with any shape other than a flat planar diamond cutting layer that has low enough residual tensile stresses at the diamond/carbide interface that will permit its use as a drilling tool.

Using the technology of the above described U.S. patents, it is relatively simple to produce diamond composite compacts with concave, convex or other non flat cutting surfaces. This allows much greater freedom of design of drag type diamond compact drilling bits that are fitted with diamond cutters having significantly greater impact strengths and wear resistance. This technology is taught in U.S. Pat. No. 4,858,707. This patent is also assigned to the same assignee as the present invention and incorporated herein by reference.

SUMMARY OF THE INVENTION

According to the present invention, there is provided a significant improvement in the overall drilling performance of drill bits fitted with diamond compact cutters that have been designed by optimizing the physical strengths of bits produced under the technology taught in U.S. Pat. No. 4,858,707.

One object of the present invention is to modify the curvature geometry of the diamond cutting surface to significantly increase the drilling rate of the bit compared to the prior art. This curvature radius is maximized to the extent that, for a given range of rock strengths and types, the curvature gives the optimum back rake angle (negative rake angle) range to provide the best shear action on the rock considering the internal friction factor for that range of geological formations.

It is also a specific object of the present invention that the idealized curvature of the diamond cutting face provides both positive and negative side rake to afford complete removal of drilled cuttings or other detritus from the cutting face, thereby always presenting a clean cutting edge to the formation.

Yet another object of the present invention whereby the idealized curved side rake surfaces being constantly wiped clean provides for constant drilling fluid flushing the diamond cutting edge. This greatly aids in cooling the cutters below their thermal degradation limit. This permits much less wear on the cutter and greater drilling life.

Still another object of the present invention is that the rearwardly curved faces of the cutting elements perform as small individual bit stabilizers reducing the tendency of the drag bit to drill off-center, gyrate or whirl. This substantially reduces the injurious vibrations common to prior art flat face cutter bits. Minimizing vibrations greatly reduce impact damage to the diamond cutter edges and faces, thereby measurably increasing the life expectancy of the bit.

Moreover, the use of curved diamond faces show a marked reduction in damaging torque variations when drilling broken or laminated formations.

A diamond rock bit is disclosed having one or more diamond inserts secured within a first cutting face formed by a rock bit body. The body further forms a second open threaded pin end, a fluid chamber and one or more nozzle passages through the cutting face. The one or more diamond insert consists of a diamond cutter end, an intermediate cylindrical body and a base end. The cutter end forms a convex surface with a radius about six times the radius of the cylindrical body. The curved surface provides a positive and negative side rake angle to deflect detritus from the curved diamond face and to help cool and clean the diamond cutters while drilling an earthen formation.

An advantage of the present invention over the prior art is to modify the curvature geometry of the diamond cutting surface to significantly increase the drilling rate of the bit compared to the prior art. This curvature radius is maximized to the extent that, for a given range of rock strengths and types, the curvature gives the optimum back rake angle range to provide the best shear action on the rock formation.

Another advantage of the present invention over the prior art is that the idealized curvature of the diamond cutting face provides both positive and negative side rake to afford complete removal of drilled cuttings or other detritus from the cutting face, thereby always presenting a clean cutting edge to the formation.

Still another advantage of the present invention over the prior art is the idealized curved side rake surfaces being constantly wiped clean provides for constant drilling fluid flushing the diamond cutting edge. This greatly aids in cooling the cutters below their thermal degradation limit.

Yet another advantage of the present invention over the prior art is that the rearwardly curved faces of the cutting elements perform as small individual bit stabilizers reducing the tendency of the drag bit to drill off-center, gyrate or whirl. This substantially reduces the injurious vibrations common to prior art flat face cutter bits.

An advantage of prime importance in the present invention is maintaining or increasing the physical strengths and wear resistance of the diamond cutters. This is provided by having optimum diamond face curvature to provide high drilling rates, but concurrently putting the diamond face in a high compressive residual stress which minimizes delamination, chipping or fracturing of the diamond table.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
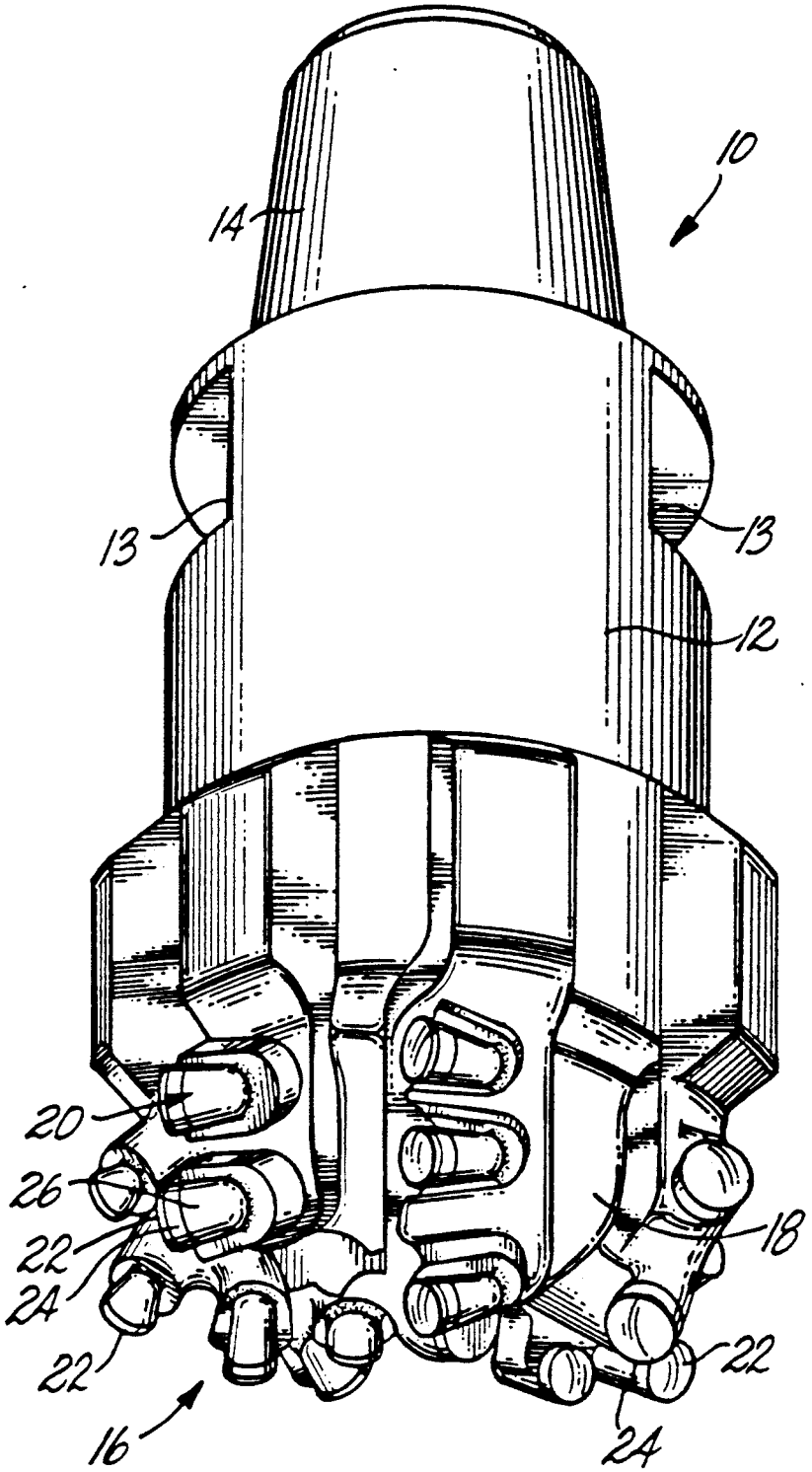
FIG. 1 is a perspective view of a diamond drag bit of the present invention.

FIG. 1 illustrates a diamond drag rock bit generally designated as 10. The drag bit 10 consists of a bit body 12, threaded pin end 14 and cutting end generally designated as 16. A pair of tool groove slots 13 on opposite sides of the bit body 12 provide a means to remove the bit from a drill string (not shown).

At the cutting end 16 is formed a bit face 18 that contains a multiplicity of diamond faced cylindrical studs generally designated as 20 extending therefrom. The diamond stud 20, for example, consists of a diamond disc 22, a cylindrical backing support segment 24 and a cylindrical stud body 26.

The disc 22 is fabricated from a tungsten carbide substrate 24 with a polycrystalline diamond layer sintered to the face of the substrate. The diamond layer, for example, is formed with a convex surface. The convex surface preferably forms a portion of a sphere with a radius about six times the radius of the stud body 26.

Figure 2:
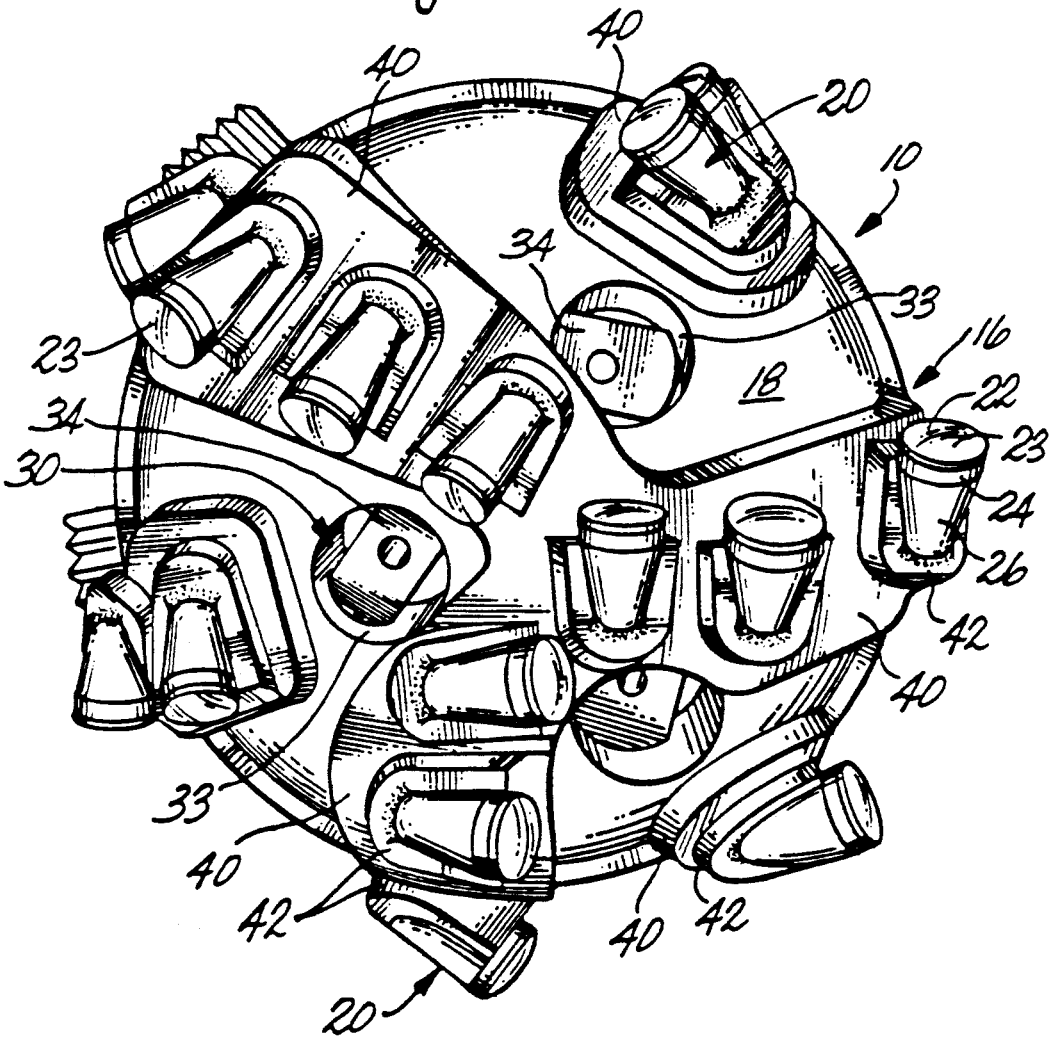
FIG. 2 is a top view of the cutting head of the drag bit.

FIG. 2 illustrates the cutting end 16 of the bit 10 with the inserts 20 imbedded in, for example, a matrix of tungsten carbide making up the head of the bit. Each of the inserts 20 are strategically positioned in the face 18 of the bit. Formed in the face is one or more fluid passages generally designated as 30. Each fluid passage communicates with a plenum chamber 32 formed within bit body 12 (not shown). A nozzle 34 is, for example, threaded into nozzle opening 33 at the exit end of the fluid passage 30. Drilling fluid or "mud" is directed out of the nozzles 34 toward a borehole bottom 35 (FIG. 6) to clear detritus 37 from the bottom and to cool and clean each of the diamond inserts 20.

Figure 6:
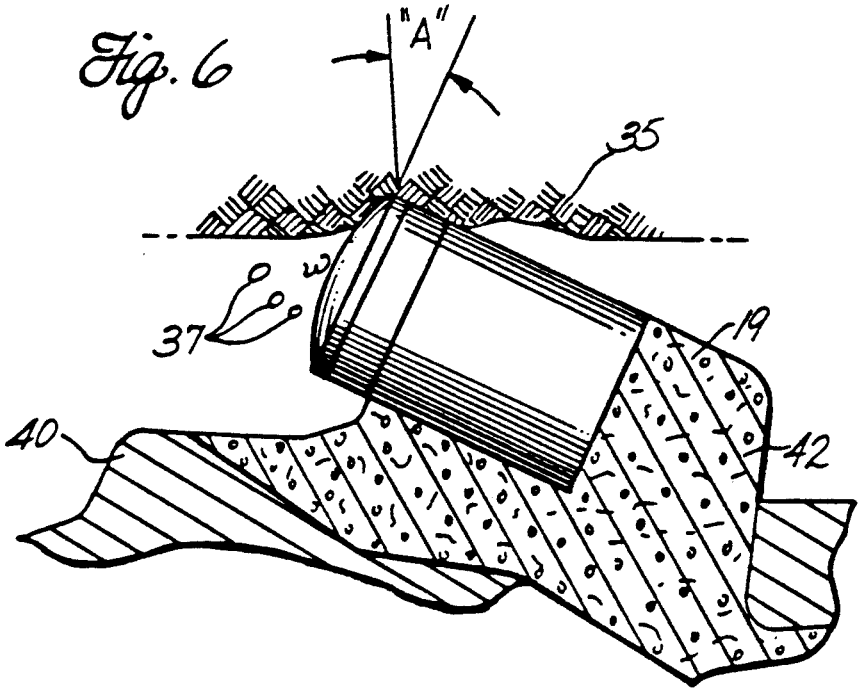
FIG. 6 is a partial cross-section of a cylindrical diamond cutter illustrating the varying negative rake angle of the convex diamond face as the insert penetrates an earthen formation.

Cutting face 18 additionally forms raised ridges 40 that support insert protrusions 41. Each insert protrusion 41 partially encapsulates the base 26 of insert 20. Insert 20 is positioned with the convex diamond disc 22 at a negative rake angle "A" with respect to the bottom of the borehole 35 (FIG. 6). Obviously, with a convex or spherically shaped disc 22, the deeper the diamond cutter penetrates the formation 35, the negative rake angle will change accordingly. The rake angle "A" will be less negative the deeper the penetration of the disc 22.

Figure 5:
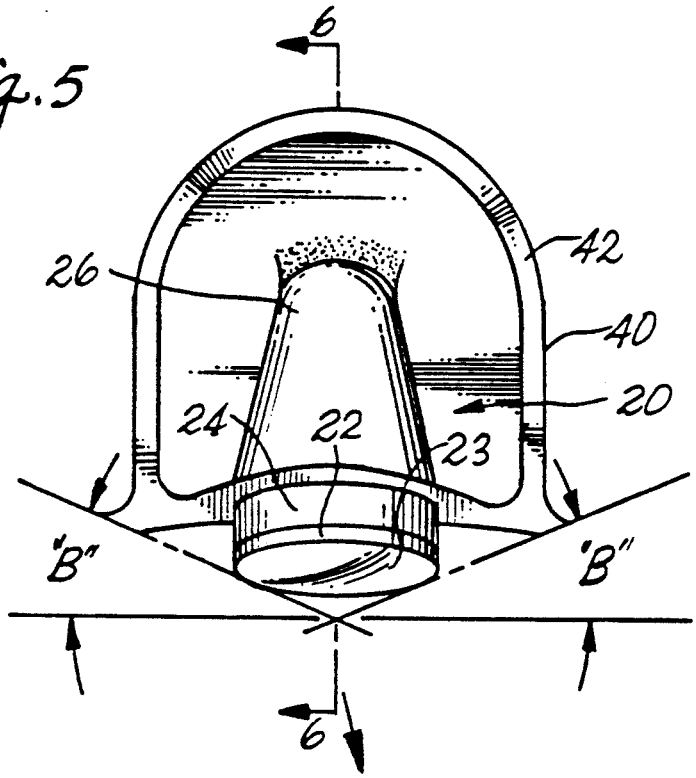
FIG. 5 is a top view of one of the cylindrical diamond inserts secured in a matrix forming the face of the drag bit.

Moreover, with reference to FIG. 5, since the disc 22 is convex, detritus 37 is deflected away (angle "B") from the diamond cutting surfaces 39 hence, flushing and cooling fluid is more readily able to maintain the integrity of the diamond during operation of the bit in a borehole.

Figure 3A:
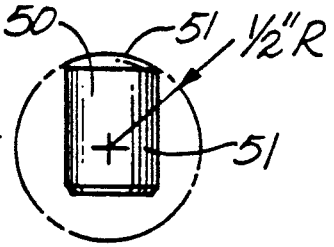
Fig. 3a PRIOR ART
FIGS. 3*a* and 3*b* depict a side view of a prior art diamond dome insert and a prior art diamond flat disc type insert.

The prior art depicted in FIG. 3*a* illustrates a typical diamond domed insert 50 with a cylindrical base 51 having a 0.500 inch diameter with a dome (51) radius of 0.500 inch. While the foregoing domed insert 50 has many attributes of the present invention, it does not have the penetration rate of the insert 20. The slightly convex surface of disc 22 more closely approximates the fast penetration rate of a flat diamond insert 54 illustrated in the prior art of FIG. 3*b*.

Figure 3B:
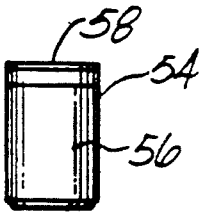
Fig. 3b PRIOR ART

Referring now to the prior art shown in FIG. 3*b*, the insert 54 has a cylindrical body 56 with a flat diamond disc 58 sintered to a tungsten carbide substrate cylinder 60 that is typically brazed to the body 56. The flat diamond insert 54 has been demonstrated to have an excellent penetration rate however, detritus build up in front of each disc 58 during bit operation in a borehole results in heat generation and ineffective cleaning and cooling that unfortunately equates to short bit life and early destruction of the diamond cutters 54.

Figure 4:
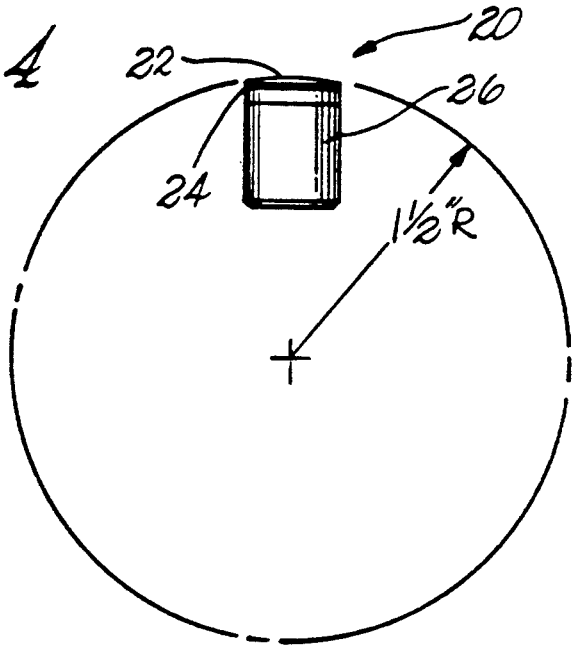
FIG. 4 is a side view of a diamond insert of the present invention having a slightly convex diamond cutter disc with a disc cutter radius about six times the radius of the supporting stud body.

The diamond inserts 20 of FIG. 4 with a relatively large convex radius to the diamond cutting face 22 (six times the diameter of the insert) has the advantage of a fast penetration rate such as that demonstrated by the flat diamond cutter while retaining the detritus deflecting capabilities of the foregoing prior art dome cutter 50. Insert 20 thus incorporates the best features of the prior art cutters 50 and 54 with none of the undesirable characteristics of either.

Referring now to FIGS. 5 and 6, FIG. 5 illustrates an insert 20 mounted in a raised protrusion 42 extending above ridge 40. The cutting end 16 affixed to bit body 12 is preferably fabricated from a matrix of tungsten carbide 19 molded in a female die.

The die, for example, forms insert pockets, raised protrusions 42, ridges 40, fluid passages 33, face 18, etc. (not shown).

Insert 20 is partially encapsulated in matrix 19 and is angled such that diamond disc 22 is at a positive rake angle "A" (FIG. 6). This angle "A" is between ten and twenty degrees with respect to a borehole bottom 35. The preferred rake angle is 20 degrees.

The top view of insert 20 (FIG. 5) with the slightly curved surface 23 deflects debris away from an apex of the disc 22. This characteristic is indicated by angle "B". As heretofore described, detritus does not build up against the curved face 23 hence, the cutting face 23 stays free of obstruction. The drilling rig mud or fluid easily cleans and cools each of the multiple diamond inserts affixed within face 18 of cutting head 16.

Figure 7:
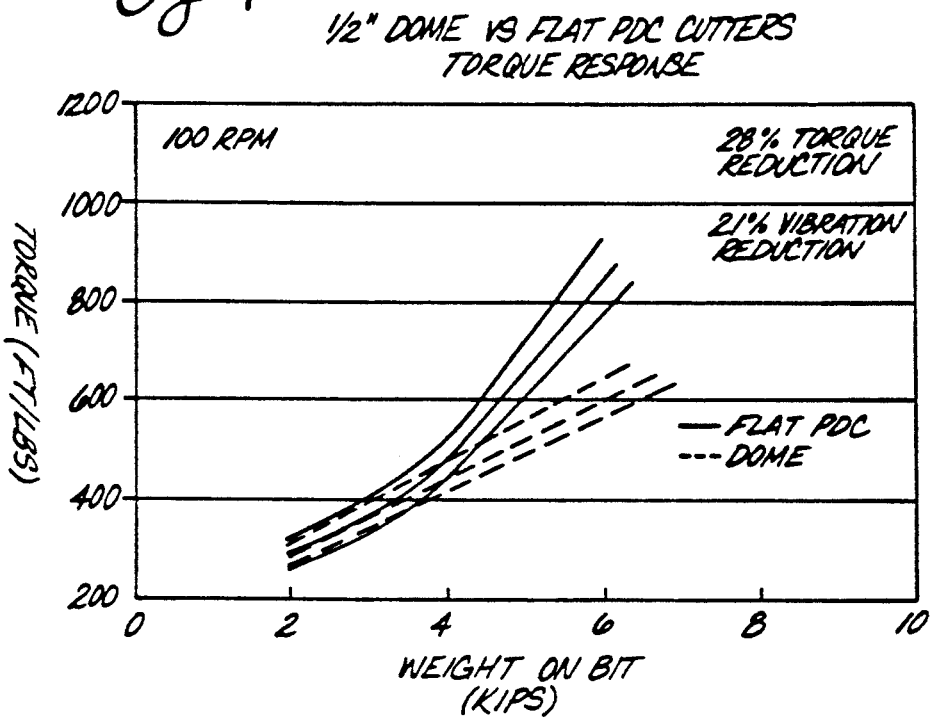
FIG. 7 is a chart indicating torque response of a dome vs. flat diamond cutter.

Referring now to FIG. 7, the chart illustrates a reduction in torque when a dome insert (20 and 50) is utilized. The flat diamond inserts 54 tend to easily torque up and as a result, vibrate badly in a formation. The dome insert 50 of the prior art, while it has less of a tendency to torque up and vibrate, bit penetration rate is far less than the flat faced prior art insert 54.

Figure 8:
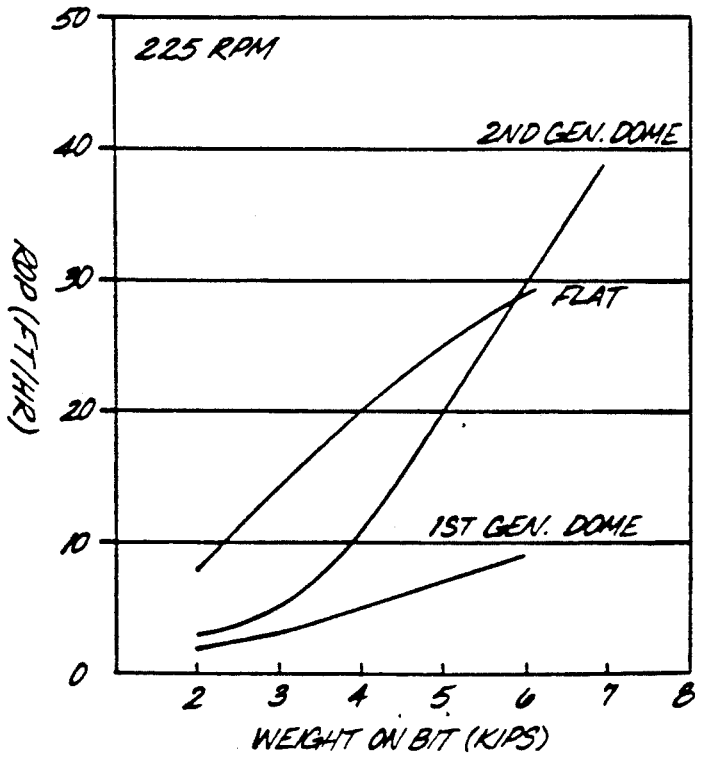
FIG. 8 is a chart comparing weight response of a flat vs. first and second generation diamond dome cutters.
Figure 9:
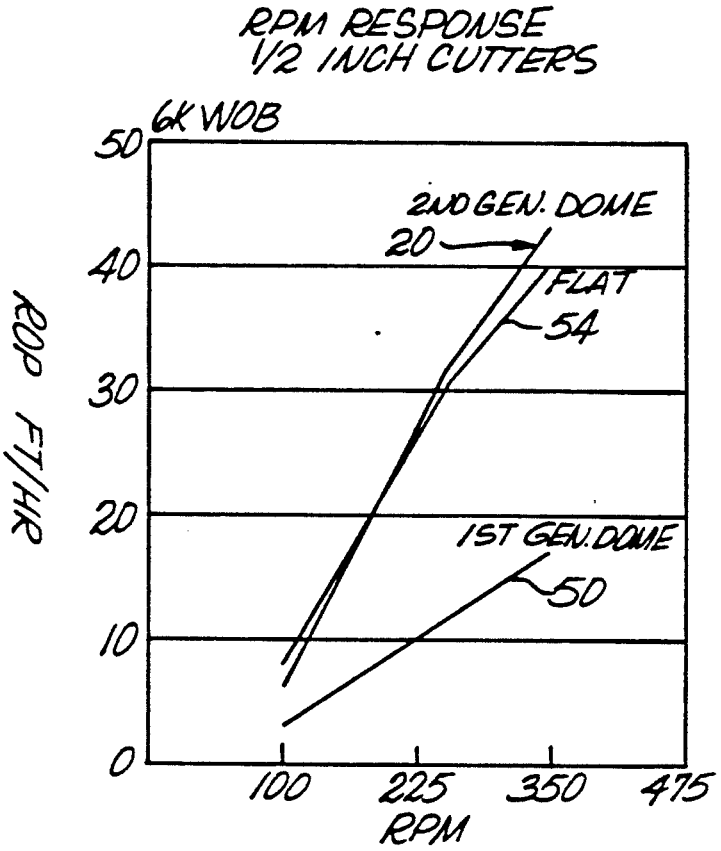
FIG. 9 is a chart comparing RPM response of a flat vs. first and second generation diamond dome cutters.

This phenomenon is clearly shown in the weight response chart of FIG. 8 and the RPM response chart of FIG. 9. In FIG. 8, the ROP (rate of penetration) is increased for the second generation domed insert 20 of the present invention over both the prior art dome insert 50 and the flat insert 54. As the WOB (weight on bit) increases, the bit penetration "tails off" for both the prior art dome and flat insert type bits.

The chart of FIG. 9 indicates as the RPM (revolutions per minute) increases, the ROP is better for the insert 20 than the prior art flat insert 54 and much better than the first generation dome insert 50.

Figure 10:
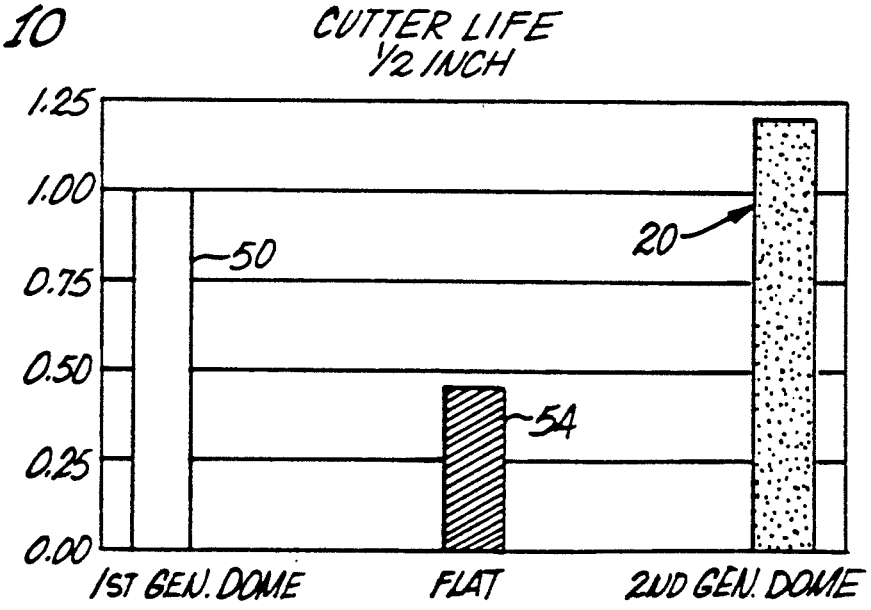
FIG. 10 is a cutter life chart comparing a flat vs. first and second generation diamond dome cutters.

Finally, the FIG. 10 chart reveals the extended life of the insert 20 of the present invention over both the flat and dome inserts of the prior art.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A diamond rock bit having one or more diamond inserts secured within a first cutting face formed by a rock bit body, the body further forming a second open threaded pin end, a fluid chamber and one or more nozzle passages through said cutting face, said one or more diamond insert comprising:

a diamond cutter end, an intermediate cylindrical body and a base end, said cutter end forming a convex surface with a radius about six times the radius of said cylindrical body, the convex diamond cutter end provides optimum rock shearing ability with a positive and negative side rake angle to deflect detritus from the curved diamond face and to help cool and clean the diamond cutters while drilling an earthen formation.

2. The invention as set forth in claim 1 wherein said convex surface is a portion of a sphere atop a cylindrical substrate, said substrate being secured to said cylindrical body.

3. The invention as set forth in claim 1 wherein said diamond cutter end comprises polycrystalline diamond sintered to said substrate.

* * * * *